United States Patent [19]

Keith

[11] Patent Number: 4,519,620

[45] Date of Patent: May 28, 1985

[54] CORE CHUCK WITH RESILIENT ROLLERS

[75] Inventor: Robert D. Keith, Bridgewater, Mass.

[73] Assignee: Double E Company Inc., Brockton, Mass.

[21] Appl. No.: 475,900

[22] Filed: Mar. 16, 1983

[51] Int. Cl.[3] ..... B23B 31/40

[52] U.S. Cl. ..... 279/2 R; 82/44; 242/72 R; 269/48.1; 279/1 Q

[58] Field of Search ..... 279/2 R, 6, 1 Q; 242/72 R, 72.1, 72 B; 269/48.1, 48.2, 48.3; 82/44

[56] References Cited

U.S. PATENT DOCUMENTS 3,007,652 11/1961 Heckman ..... 279/6 X

FOREIGN PATENT DOCUMENTS 6405939 11/1964 Netherlands ..... 279/1 Q

*Primary Examiner*—Z. R. Bilinsky

[57] ABSTRACT

A torque-transmitting chuck comprising an interior member having a longitudinal axis and exterior circumferentially-spaced, longitudinally-extending camming surfaces. A generally axially-extending, circular in cross-section roller engages each of the camming surfaces. Each roller is arranged to engage the interior of a hollow core and move radially outwardly relative to the interior member in response to movement of the roller circumferentially of the interior member. The chuck is characterized in that each of the rollers includes an axially-extending center rod and a thick surrounding layer of resilient material the outer circumferential surface of which contacts the camming surfaces and core. The layer has a hardness in the range of 30 to 90 durometer and a radial thickness of not less than about $\frac{1}{8}$ inch.

16 Claims, 3 Drawing Figures

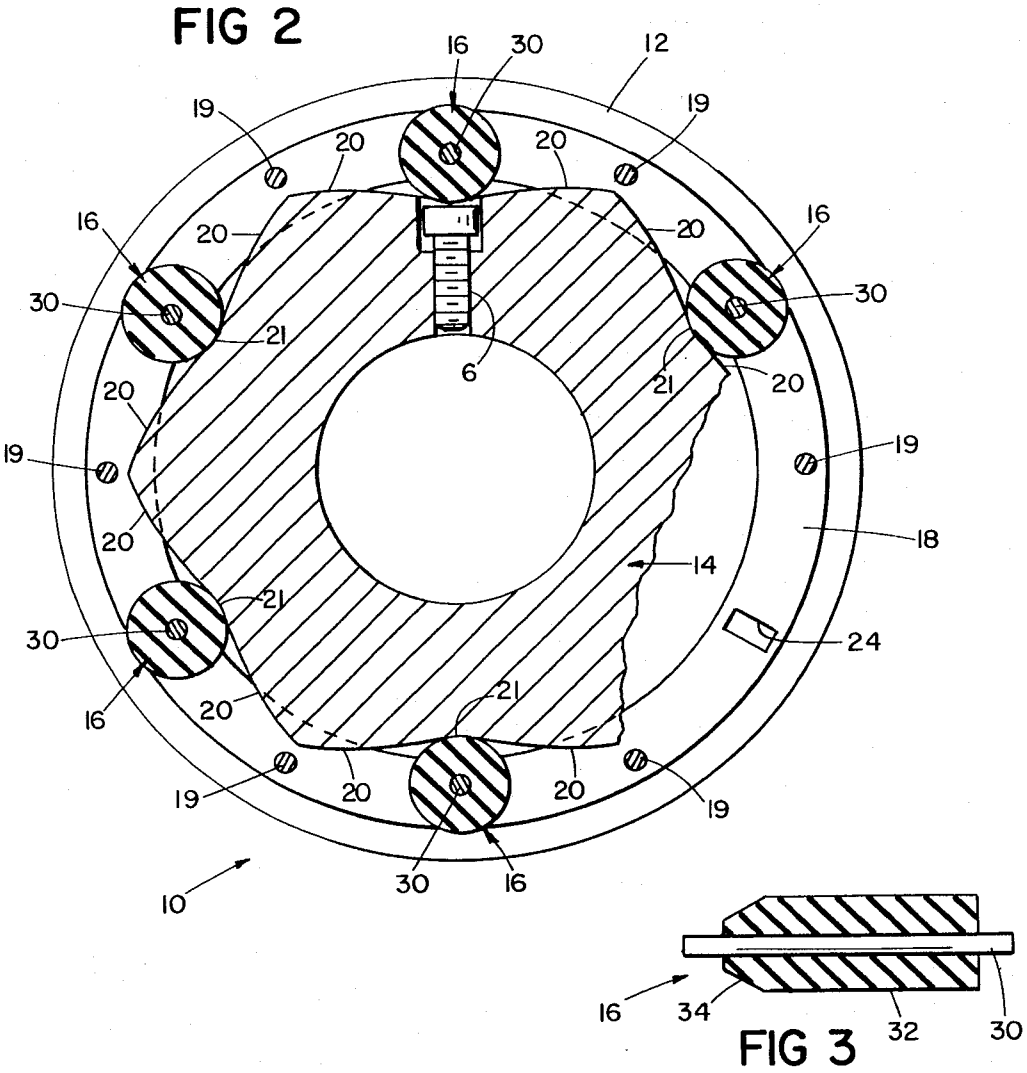
FIG 2
FIG 3
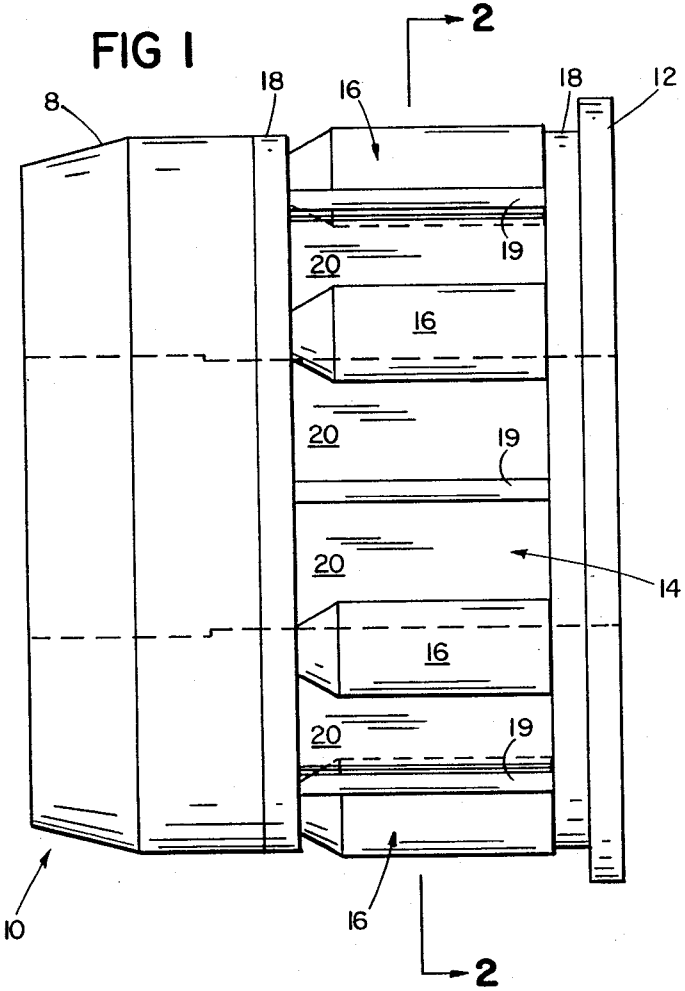
FIG 1

CORE CHUCK WITH RESILIENT ROLLERS

This invention relates to improvements in chucks suitable for internally gripping hollow members.

There are a number of manufacturing and similar operations in which a roll of material (e.g., paper, cloth, metal sheeting or the like) must be locked to a supporting shaft or arm for winding the material onto or off the roll. In such processes, it is important that the roll not rotate relative to the shaft. A number of different devices have been designed for so mounting such rolls. For example, U.S. Pat. No. 1,122,627 shows a device in which axially-extending metal rods or rollers move radially outwardly into engagement with the cylindrical core of a surrounding roll; and U.S. Pat. No. 3,792,868 shows a core chuck in which axially-extending rollers force surrounding steel jaws radially outwardly into engagement with the core interior. With jaw-less devices such as those shown in the first-mentioned patent it is difficult to prevent relative rotation of the chuck and surrounding core. Devices that include jaws, such as those shown in the latter patent, are better in terms of preventing slippage, but are more expensive and susceptible to clogging from debris. With both types of devices it is often difficult to provide slip-free engagement when lightly loaded or with hard (e.g., steel) cores, and vibration can present difficult operational problems.

An object of the present invention is to provide a jaw-less chuck that provides superior engagement under light loads and with hard cores, and minimizes problems caused by vibration.

The invention features a torque-transmitting chuck comprising an interior member having a longitudinal axis and exterior circumferentially-spaced, longitudinally-extending camming surfaces, and a plurality of generally axially-extending, circular in cross-section rollers each of which engages one of the camming surfaces. Each roller moves radially outwardly into engagement with a core interior in response to relative circumferential movement of the roller and interior member. The chuck is characterized in that each roller includes a thick axially-extending annular layer of relatively high-friction, elastomeric material that surrounds the roller's center rod and defines the outer circumferential surface of the roller. The layer has a hardness of not less than 30 or more than 90 durometer and a radial thickness of not less than $\frac{1}{8}$ inch.

In preferred embodiments, the layer is polyurethane having a hardness in the range of 50–80 durometer (and preferably about 60), the roller center rod is steel, and the radial thickness of the layer is not more than about $\frac{1}{2}$ inch, and preferably is not less than about equal to or more than about twice the diameter of the rod. The polyurethane layer circumferentially surrounds and either is a sleeve frictionally secured to or is molded in place around the rod.

Other objects, features and advantages will appear from the following detailed description of a preferred embodiment of the invention, taken together with the attached drawings in which:

FIG. 1 is a plan view of a core chuck embodying the present invention;

FIG. 2 is a sectional, partially cut-away, view taken at 2—2 of FIG. 1; and,

FIG. 3 is a sectional view of a roller.

The drawings illustrate a core chuck 10 of the type which is securable to a shaft for supporting a roll of material wound about a tubular core. Chuck 10 includes a tapered nose section 8 at one end thereof, an elongated inner member 14 surrounded by a series (i.e., six) of axially-extending rollers 16 spaced at regular 60° intervals from each other, and a core stop 12 at its other end. Roller retaining rings 18 rotatably mounted at opposite ends of member 14 maintain the spacing of rollers 16. Axial pins 19 connect the rings 18 and insure that they rotate together.

Inner member 14 defines six circumferentially spaced sets of radially outwardly projecting camming surfaces 20. Each set includes two constant rise camming surfaces 20 extending, circumferentially of member 14, in opposite directions from a central low-point or null 21. The two camming surfaces 20 of each set are mirror images, and each set (including two surfaces 20) subtends a total arc of about 60 degrees. Such camming surfaces are described in detail in the assignee's U.S. Pat. No. 4,193,633, which is hereby incorporated by reference.

Each roller 16 includes a central steel rod 30, as shown a steel rod about $\frac{1}{8}$ in. in diameter, surrounded by a thick polyurethane sleeve 32. Sleeve 32 extends substantially the full length of the exposed portion of the roller, i.e., the full length of the roller except for the opposite ends of rod 30 which are received within recesses 24 in retaining rings 18. One end 34 of each sleeve 32 is conically tapered to provide for smooth entry of the core chuck 10 into the core. The rest of sleeve 32 has a thickness (measured radially from the outer periphery of rod 30 to the outer periphery of the sleeve) of $\frac{1}{4}$ in. The particular polyurethane used in this embodiment was obtained from Globe Rubber Co. of Rockland, Mass. and has a durometer of 60.

As shown, the periphery of the sleeve 32 of each roller 16 engages one of the sets of camming surfaces. Roller orienting rings 18 maintain the circumferential spacing of the rollers, but at the same time permit the rollers to be displaced radially by the camming surfaces 20. Each roller ring 18 is free to rotate relative to inner member 14 and includes six recesses 24, spaced at 60 degree intervals, in which the opposite ends of the roller rods 30 are disposed. As shown in the cut-away portion of FIG. 2, each recess 24 is a radially-extending slot which both permits and limits radial movement of a respective roll 16.

In operation, chuck 10 is placed on a shaft and secured thereto by tightening a set screw 6. The shaft and core 10 are then inserted within the tubular core until the core abuts the core stop 12, thus positioning the core axially. A conventional roll collar may then be fixed to the shaft to abut the other end of the core.

A braking or motive force may be applied to the core, and to the roll of material wound thereupon, as follows.

With the chuck 10 inserted into the tubular core, the weight of the core, and any material wound thereupon, will bear upon the roller(s) 16 which happen(s) to be facing upward on the top side of the chuck 10. Any relative rotation between the core and the chuck 10 will cause the rollers 16 to roll on the camming surfaces 20, causing the rollers to move radially outwardly. The roller-retaining rings 18 assure simultaneous circumferential displacement of all the rollers 16 and consequent simultaneous outward radial movement of the rollers so as to uniformly and securely engage the inner surface of the tubular core 12.

The thick polyurethane sleeves 32 of rollers 16 deform as they are pressed radially outwardly against the interior of the core, tightly engage both the core and the camming surfaces 20 of interior member 14, and prevent slippage between the core chuck 10 and the surrounding tubular core. To insure such essentially slip-free engagement, it has been found important that the sleeve be relatively thick (to provide for sufficient deformation) and that it be made of a material that has a high surface coefficient of friction (further to reduce slippage of the roller relative to the core). It also has been found that a relatively thick elastomeric layer dampens vibration of the core relative to the chuck.

The particular thickness of the sleeve 32 depends principally on the size of the particular chuck 10. The chuck of the preferred embodiment is designed to engage a core having an interior diameter of about 5 inches. In, for example, a chuck designed to support a 12 inch core, the steel rod 30 of each roller 16 is a steel pin about ½ inch in diameter and the overall diameter of the roller is about 1¼ in., i.e., the radial thickness of the sleeve 32 will be about ⅝ inch. Generally, the thickness of the elastomeric sleeve should never be less than about ⅛ inch, typically will be in the range of about equal to to about twice the diameter of the center rod of the roller, and in any event should not exceed about ½ inch.

Polyurethane elastomers have been found to be well-suited for use in the present invention. Other elastomers having similar surface friction characteristics could be used also. Regardless of the material used for the roller sleeves 32, the durometer should be in the range of about 30 to about 90 (preferably 50 to 70), and typically will be about 60.

In lieu of a sleeve that is slipped over and frictionally held in place on the steel pin which forms the center rod 30 of the roller, the elastomeric layer 32 may be molded in place around the pin.

Other embodiments will be within the scope of the following claims.

What is claimed is:

1. A torque-transmitting chuck comprising an interior member having a longitudinal axis and a plurality of exterior circumferentially-spaced, longitudinally-extending camming surfaces, and, a plurality of generally axially-extending, circular in cross-section rollers each of which engages one of said camming surfaces, said rollers being arranged to engage the interior of a hollow core into which said chuck may be inserted and to move radially outwardly relative to the interior member and into engagement with the interior of said core in response to movement of said rollers circumferentially relative to said interior member, said chuck being characterized in that each of said rollers includes a center rod extending axially the length of said roller and an axially-extending annular layer of elastomeric material circumferentially surrounding said rod and defining the surface of said roller that engages a said camming surface and is arranged to engage the interior of said core, said layer having a hardness of not less than in the range of about 30 to about 90 durometer and a radial thickness of not less than about ⅛ inch.

2. The chuck of claim 1 wherein said layer is polyurethane.

3. The chuck of claim 1 wherein the radial thickness of said layer is not less than about equal to or more than about twice the diameter of said rod.

4. The chuck of claim 1 wherein said hardness is in the range of 50 to 70 durometer.

5. The chuck of claim 4 wherein said hardness is about 60 durometer.

6. The chuck of claim 1 wherein said layer comprises a sleeve surrounding and frictionally secured to said rod.

7. The chuck of claim 1 wherein said layer is molded around said rod.

8. The chuck of claim 1 wherein said thickness is in the range of about ⅛ inch to about ½ inch, and said hardness is in the range of 50 to 70 durometer.

9. The chuck of claim 8 wherein said thickness is in the range of about the diameter to about twice the diameter of said rod.

10. The chuck of claim 8 wherein said hardness is about 60 durometer.

11. The chuck of claim 8 wherein said layer comprises polyurethane.

12. A torque-transmitting chuck comprising an interior member having a longitudinal axis and a plurality of exterior circumferentially-spaced, longitudinally-extending camming surfaces, and, a plurality of generally axially-extending, circular in cross-section rollers each of which engages one of said camming surfaces, said rollers being arranged to engage the interior of a hollow core into which said chuck may be inserted and to move radially outwardly relative to the interior member and into engagement with the interior of said core in response to movement of said rollers circumferentially relative to said interior member, said chuck being characterized in that each of said rollers includes a center rod extending axially the length of said roller and an axially-extending annular layer of elastomeric material circumferentially surrounding said rod and defining the surface of said roller that engages a said camming surface and is arranged to engage the interior of said core, whereby said layer will deform when said roller is pressed into engagement with a surrounding core and thereby substantially prevent slippage of said roller relative to said core.

13. The chuck of claim 12 wherein said layer of a material having a surface coefficient of friction substantially equal to that of polyurethane.

14. The chuck of claim 13 wherein said layer is polyurethane.

15. The chuck of claim 12 wherein the thickness of said core is not less than the smaller of about the diameter of said rod and about ⅛ inch.

16. The chuck of claim 15 wherein the thickness of said core is not greater than the greater of about ½ inch and about twice the diameter of said rod.

* * * * *